US006170479B1

(12) United States Patent
Taplan

(10) Patent No.: US 6,170,479 B1
(45) Date of Patent: Jan. 9, 2001

(54) ARRANGEMENT FOR ATTACHING AN ATMOSPHERIC GAS BURNER TO THE BURNER OPENING OF A COOKING SURFACE THAT IS MADE OF GLASS OR GLASS CERAMIC AS WELL AS A COOKING AREA WITH SUCH AN ARRANGEMENT

(75) Inventor: Martin Taplan, Rheinböllen (DE)

(73) Assignee: Schott Glas, Mainz (DE)

( * ) Notice: Under 35 U.S.C. 154(b), the term of this patent shall be extended for 0 days.

(21) Appl. No.: 09/302,442

(22) Filed: Apr. 30, 1999

(30) Foreign Application Priority Data

May 2, 1998 (DE) ..... 198 19 732

(51) Int. Cl.[7] ..... F24C 3/00; F24C 15/10; F16L 5/00

(52) U.S. Cl. ..... 126/39 R; 126/39 H; 126/39 N; 126/39 E; 126/214 A; 248/56; 411/156

(58) Field of Search ..... 126/39 R, 39 N, 126/39 B, 39 H, 214 R, 214 A, 39 E, 41 R; 248/56; 411/156, 544, 960, 522

(56) References Cited

U.S. PATENT DOCUMENTS

| | | | | |
|---|---|---|---|---|
| 404,284 | * | 5/1889 | Johnson | 411/156 |
| 2,014,558 | * | 9/1935 | Cramer | 248/56 |
| 2,078,453 | * | 4/1937 | Miller | 248/56 |
| 2,232,482 | * | 2/1941 | Schulz | 126/39 R |
| 2,487,803 | * | 11/1949 | Heimann | 248/56 |
| 2,595,005 | * | 4/1952 | Shelton et al. | 126/39 R |
| 2,744,185 | * | 5/1956 | Cawley | 248/56 |
| 2,948,141 | * | 8/1960 | Vahlstrom | 248/56 |
| 3,171,946 | * | 3/1965 | Ammerman | 248/56 |
| 3,197,615 | * | 7/1965 | Wetlesen | 248/56 |
| 4,601,448 | * | 7/1986 | Miyazaki et al. | 248/56 |
| 4,624,429 | * | 11/1986 | Miyazaki | 248/56 |
| 4,627,411 | * | 12/1986 | Mertler | 126/39 E |
| 4,640,478 | * | 2/1987 | Leigh-Monstevens | 248/56 |
| 4,735,534 | * | 4/1988 | Oehlke | 248/56 |
| 4,886,408 | * | 12/1989 | Killian et al. | 411/522 |
| 5,046,477 | * | 9/1991 | Bennett et al. | 126/39 R |
| 5,443,380 | * | 8/1995 | Riehl | 126/39 E |
| 5,468,145 | * | 11/1995 | Ferlin | 126/39 R |
| 5,549,100 | * | 8/1996 | Heisner et al. | 126/39 R |
| 5,623,917 | * | 4/1997 | Dinaso et al. | 126/39 R |
| 5,636,540 | * | 6/1997 | Myers | 248/56 |

FOREIGN PATENT DOCUMENTS

| | | | |
|---|---|---|---|
| 828496 | * | 12/1951 | (DE) . |
| 4442572 | | 11/1994 | (DE) . |
| 196331441 | | 8/1997 | (DE) . |
| 1218041 | * | 1/1971 | (GB) . |
| 1288840 | * | 9/1972 | (GB) . |

* cited by examiner

*Primary Examiner*—Ira S. Lazarus
*Assistant Examiner*—David Lee
(74) *Attorney, Agent, or Firm*—Millen, White, Zelano, & Braniagn, P.C.

(57) ABSTRACT

A cooking surface that is made of glass or glass ceramic and at least one atmospheric gas burner and arrangement for attachment of a gas burner to an opening for guiding the burner includes an attachment arrangement that is used in the cooking area which comprises a burner with a circumferential collar that is molded onto burner body above the cooking surface for tight seating on the cooking surface top side. The connection is made by friction or tension of the burner body with at least one spring element disposed below the cooking surface. Cooking areas with this arrangement require fewer components and less time for assembly and are easy to clean.

13 Claims, 6 Drawing Sheets

ARRANGEMENT FOR ATTACHING AN ATMOSPHERIC GAS BURNER TO THE BURNER OPENING OF A COOKING SURFACE THAT IS MADE OF GLASS OR GLASS CERAMIC AS WELL AS A COOKING AREA WITH SUCH AN ARRANGEMENT

FIELD OF THE INVENTION

This invention relates to a cooking area with a cooking surface that is made of glass or glass ceramic and at least one atmospheric gas burner as well as an arrangement for attaching the atmospheric gas burner or burners to the openings to guide the burner or burners through the cooking surface that is made of glass or glass ceramic. The invention especially relates to an attachment arrangement for protection of the opening edges from mechanical damages and for preventing dirt build-up and damages of the components that are arranged under the cooking surface as a result of liquid or food that is being cooked penetrating through the openings.

BACKGROUND OF THE INVENTION

In the gas or mixed ranges with cooking surfaces that are made of glass or glass ceramic that are known in the prior art, the attachment of the atmospheric gas burners is done via adapter sheets, whereby the sheets rest with at least one strap on the burner body and are molded so that they can engage over the inside periphery of a respective cooking surface opening both on the top and on the bottom side of the cooking surface, whereby a seal and/or a heat-insulating material is inserted between adapter and cooking surface sides. In another embodiment, the inside circumferences of the sealing cuffs that encompass the openings (DE-PS 44 42 572 C1 ) are used. The actual attachment of the burner is then carried out via spring elements, which press the burner to the bottom side of the sealing cuff. The sealing cuffs are mounted in the opening of the cooking surface by being forced in, by soldering, bonding or by a bayonet container.

In DE 196 33 141 C1, the attachment is carried out with use of a metal hasp that engages over the edge of the respective openings on the glass or glass ceramic plate, whereby an elastic, self-clamping attachment ring that is formed as an annular disk from a meander-shaped annular belt is attached to this hasp as a support part, and the attachment ring presses against the metal hasp with its outside periphery and its inside periphery rests on the burner body.

These forms of attachment have the drawback, however, that they are relatively costly and time-consuming, since several individual parts are produced and must then be assembled in succession. Another drawback consists in the fact that between adapter sheet and burner, a gap still results, which, on the one hand, must be inherently sealed, and, on the other, in the event of dirt build-up occurring in the burner, additionally hampers its cleaning, optionally with the disassembly of the burner.

Known from DE 197 42 792 C1, which represents a prior art according to §3, Paragraph 2 of the Patent Law, is an atmospheric gas burner, which is attached to the cooking basin of a cooking surface that is made of glass ceramic using a multiple-part design, whereby a portion of the design extends as a cuff in an annular-disk shape over the molded element by means of sealing elements, and the other portion of the design engages below the molded element with use of an elastic metal element, which has an attachment as a support and the bottom side of the molded element as an abutment.

SUMMARY OF THE INVENTION

The object of the invention is therefore to make available a cooking area with an arrangement for attaching atmospheric gas burners to the openings of the cooking surfaces that are made of glass or glass ceramic, in which the number of components that are necessary for this purpose is greatly reduced, so that shortened assembly times are possible, and which makes it possible to clean the burners relatively simply and quickly in the case of dirt build-up, optionally by its disassembly and reassembly.

According to the invention, burner bodies are used, in which even at a height above the cooking surface top, a collar that goes around the body and is for seating on the cooking surface top and suitable holding devices for frictional and/or tension accommodation of spring elements can be molded-on directly below the cooking surface bottom side. The holding devices can be depressions that are attached to the burner body, e.g., in the form of laterally attached slots or a groove that goes around the burner body, or molded-on companion flanges, on which the spring elements rest and can engage optionally for the production of a frictional connection.

The spring elements are clamped between these holding devices on the burner body and the cooking surface bottom side in such a way that they press the burner body downward, so that the circumferential collar that is molded on above the cooking surface top is pressed against the cooking surface top in the surface area near the periphery of the cooking surface openings.

For quick assembly of a burner, only three steps are then required.

1. Insertion of the burner from above into the cooking surface opening that is provided for it;
2. Clamping of the spring element(s) between (a) holding device(s) and the cooking surface bottom side;
3. Production of the connection between burner and gas supply line.

If disassembly is advised optionally for the cleaning of a burner or for maintenance, the burner can be disassembled in a quick and uncomplicated manner with a reversed sequence of the above-mentioned steps.

According to the invention, different types of spring elements can be used. In a preferred embodiment, at least two opposing leaf springs in terms of the burner body are used. As a holding device for the leaf springs, on the one hand, depressions that are recessed in the burner body can then be used, but also on the other on companion flanges that are molded onto the burner body. Advantageously, both the depressions and the companion flanges are provided with suitable equipment, e.g., hollows, which allow the engagement of the leaf springs for frictional attachment. Instead of two leaf springs, a U-shaped leaf spring can also be used.

In an especially preferred embodiment, the spring element represents a closed tension spring that extends over the periphery of the burner body. This is present preferably in the form of an annular belt whose length can vary elastically over its entire width and is designed meander-shaped. In this case, starting at approximately the height of the cooking surface bottom side, the burner in its lower part must have as cylindrical a shape as possible. When leaf springs or U-shaped springs are used, the burner can have any other shape in its lower portion.

The meander-shaped tension spring is pushed from below over the cylindrically designed lower portion of the burner, so that the tension spring expands with its inside diameter and is therefore made too oblique in radial direction to the outside diameter. In a preferred embodiment, the mounting of the spring element on the wall of the burner that is cylinder-shaped to a very large extent is carried out only by frictional connection. The meander spring is able to clamp its hardened and sharp-edged lower edge by frictional connection in the burner wall. The bottom side of the tension spring must then be some distance apart from the cooking surface bottom side, so that the meander-shaped annular belt of the tension spring that runs obliquely upward can press against the cooking surface bottom side with its outside diameter and thus presses the collar that goes around the burner body and that rests on the cooking surface top side against the cooking surface top side.

In contrast, however, the tension spring can also engage on its inside diameter for the formation of a frictional connection with the burner body in a groove that goes around the cylindrical bottom portion of the burner or in additional partially or completely circumferential locking grooves (saw-teeth) that are molded onto the burner body or recessed, by which the hold of the burner on the cooking surface is supported and thus ensures more security against a possible slip, but such additional frictional holding elements for a meander-shaped tension spring are normally not absolutely required.

If the cooking surface in the surface area that directly adjoins the burner opening is designed flat, then the collar that preferably goes around the upper portion of the burner for seating on the cooking surface top side is also flat on its bottom side. A thermostable seal is preferably inserted between the bottom side of the collar and the surface area of the cooking surface that directly adjoins the burner opening, and the collar comes to rest on the cooking surface. The seal can be present in the form of a flat packing or can be designed as an O-ring, whereby then a groove for receiving the O-ring is recessed in the bottom side of the collar.

In an especially preferred embodiment, the cooking surface can also be curved upward in the peripheral area of the burner opening, whereby then the circumferential collar that is molded onto the burner body rests on the edge of the cooking surface top side that is curved upward. In this case, to reliably prevent food that has boiled over while being cooked from getting inside the space that is located under the cooking surface, an additional seal between the circumferential collar and the cooking surface top side may be unnecessary.

BRIEF DESCRIPTION OF THE DRAWINGS

The invention is explained in more detail below based on the adjoining figures. Here.

DETAILED DESCRIPTION

Figure 1:
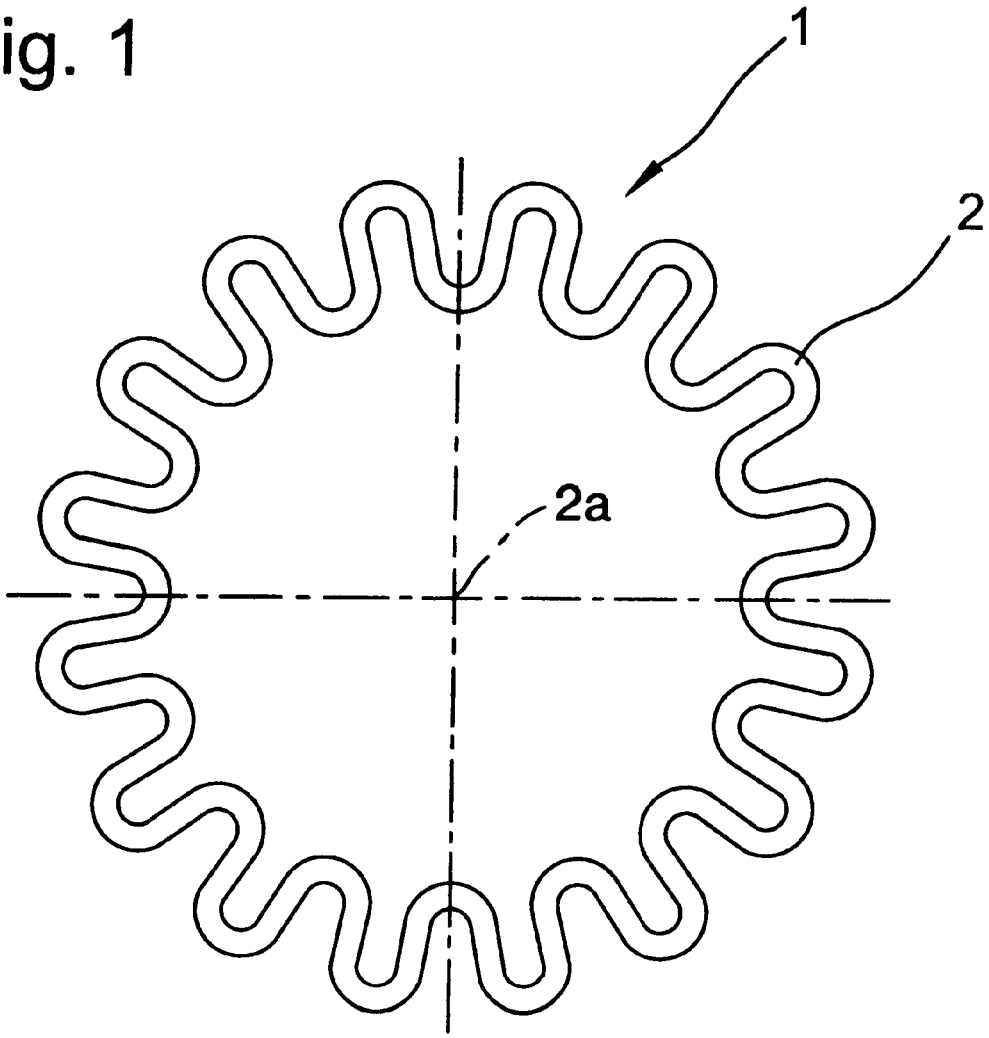
FIG. 1 shows an annular closed tension spring that is formed from a meander-shaped annular belt.

FIG. 1 shows a self-clamping tension spring 1, which consists of an annular belt 2 that is designed meander-shaped to undulate in the radial direction or rather in an axial direction with respect to an axis 2*a* and elastically deformable in peripheral direction.

Figure 2A:
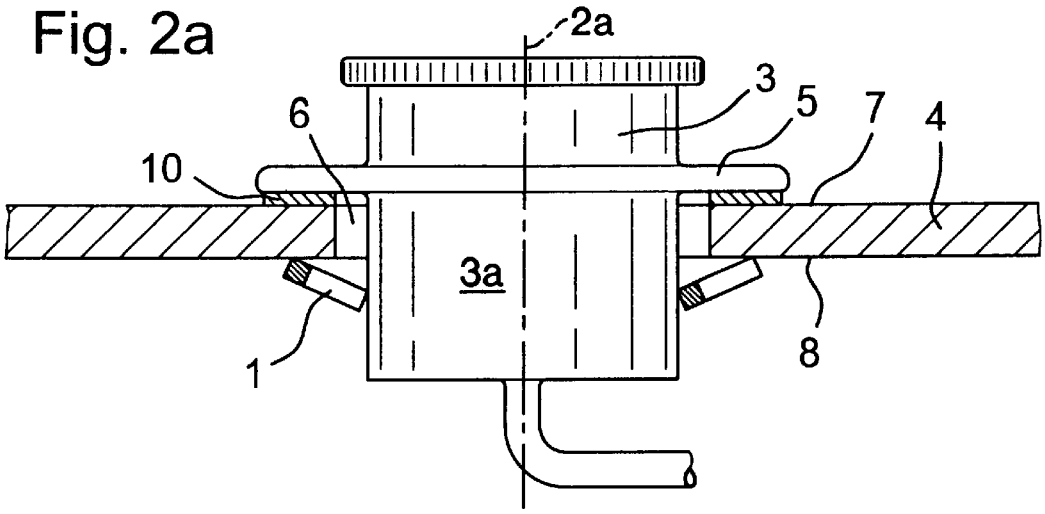
FIG. 2*a* shows a cross-section of a burner without a groove that is attached with use of a meander-shaped tension spring on a cooking surface opening.

In FIG. 2*a*, a circumferential collar 5 on the burner body or barrel portion 3*a* is molded onto burner 3 at a height above cooking surface 4, and the collar rests on surface area 7 that directly adjoins opening 6 for the burner. At a height that is slightly below cooking surface bottom side 8, a meander-shaped tension spring 1 is frictionally connected to the burner body, by the tension spring being enlarged with its inside diameter and clamped with its sharp edge to the burner body or barrel portion 3*a*. The meander-shaped annular belt of tension spring 1 that runs obliquely upward then presses with its outside diameter against cooking surface bottom side 8 and then holds the burner in its position, together with collar 5 that goes around the burner body and that rests on cooking surface top side 7. A seal 10 is preferably still made between collar 5 and cooking surface top side 7.

Figure 2B:
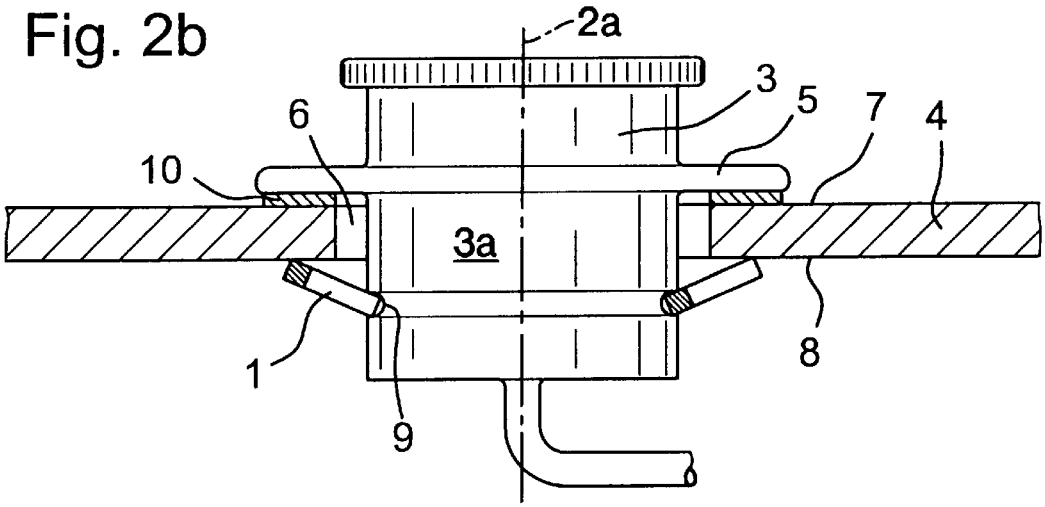
FIG. 2*b* shows a cross-section of a burner with a groove that is attached with use of a meander-shaped tension spring on a cooking surface opening.

In FIG. 2*b*, the meander-shaped tension spring is connected by friction and tension with the burner body, by the meander-shaped tension spring being engaged with its lower edge additionally in a groove 9 that goes around the cylindrical lower part of the burner, which is at a distance from cooking surface bottom side 8 so that the meander-shaped annular belt of tension spring 1 that runs upward can press against cooking surface bottom side 8 with its outside diameter.

Figure 2C:
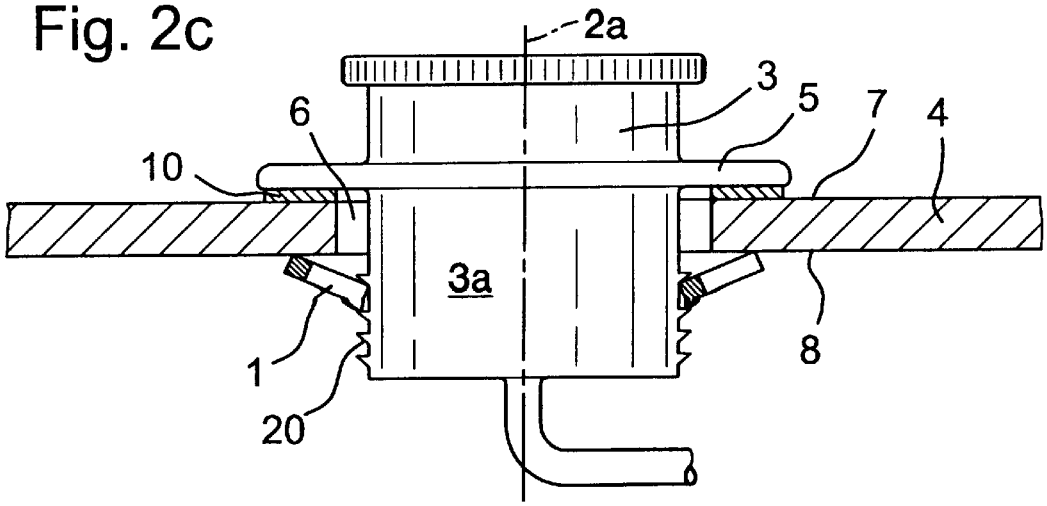
FIG. 2*c* shows a cross-section of a burner with a saw-tooth profile that is attached with use of a meander-shaped tension spring to a cooking surface opening.

In FIG. 2*c*, the attachment of the burner is also done by friction and/or tension by the meander-shaped tension spring being additionally accommodated with its lower edge by sawtooth-profile locking grooves 20, which completely or partially run around the cylindrical lower portion of the burner and are either molded onto the burner body or are recessed in the latter.

Figure 3:
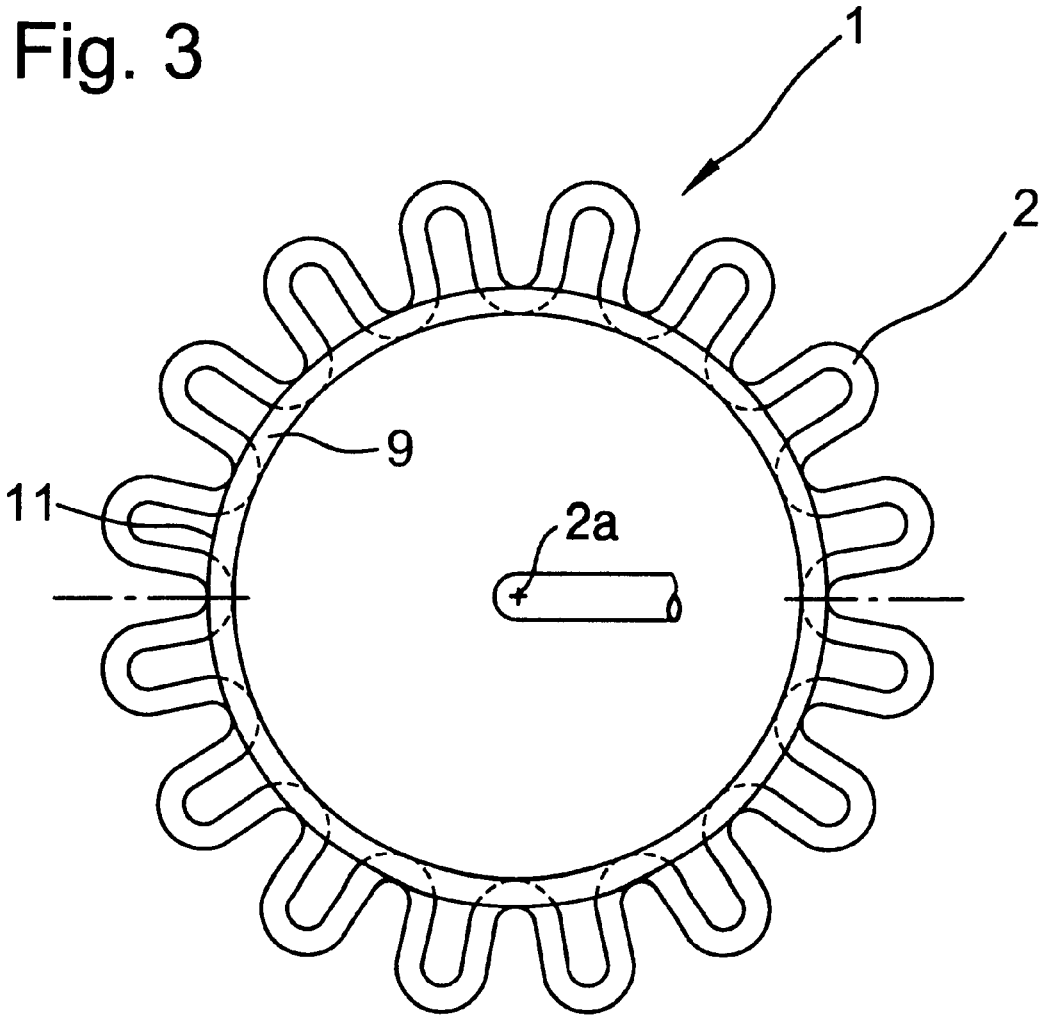
FIG. 3 shows a view from below of a meander-shaped tension spring that is frictionally connected to a burner body that is cylindrical in the lower portion.

In FIG. 3, tension spring 1 that is engaged in groove 9 for frictional connection and is taken up on cylindrical burner body 11 can be detected with a view from below.

Figure 4:
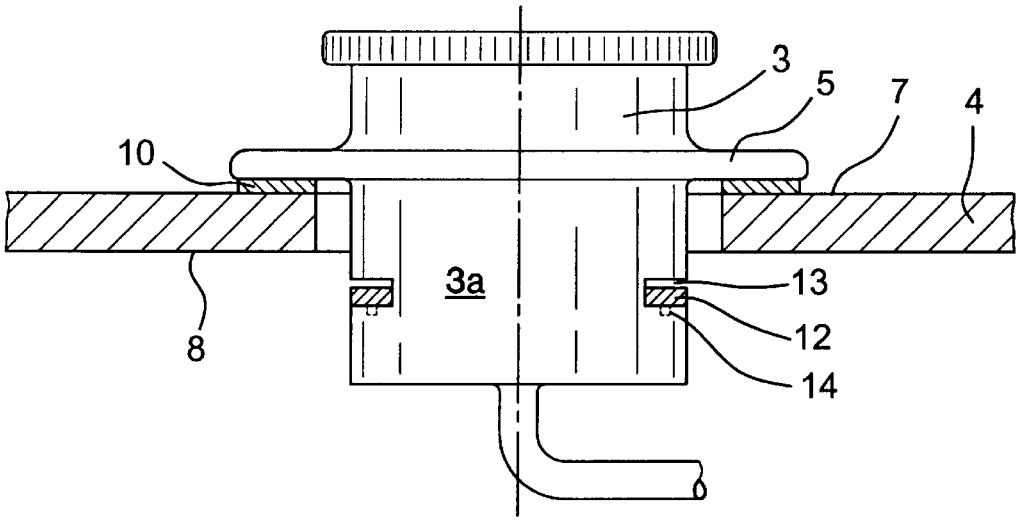
FIG. 4 shows a cross-section of a burner that is attached to a cooking surface opening with use of two leaf springs.

In FIG. 4, two opposing leaf springs 12 on the burner body can be seen, whose attachment to burner body 3 was done with use of depressions 13 that are recessed in the body at a height that is slightly below cooking surface bottom side 8, whereby in addition, a frictional connection between spring element and burner body was produced by engaging in suitable recesses 14.

Figure 5:
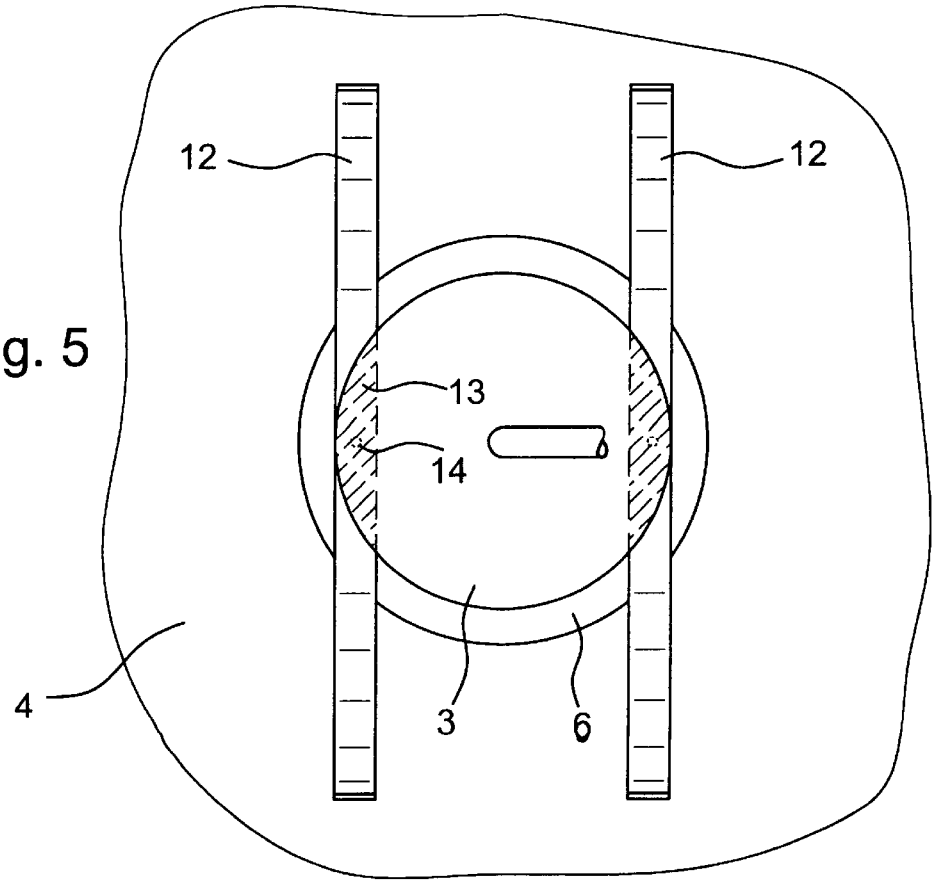
FIG. 5 shows a view from below of two leaf springs that are frictionally connected to a cylindrical burner body.

From FIG. 5, it can be detected with a view from below how leaf springs 12 are attached by friction and/or tension with use of depressions 13 and recesses 14 on burner body 3, and how leaf springs 12 on their ends that are bent upward in the direction of cooking surface 4 press against cooking surface bottom side 8.

Figure 6:
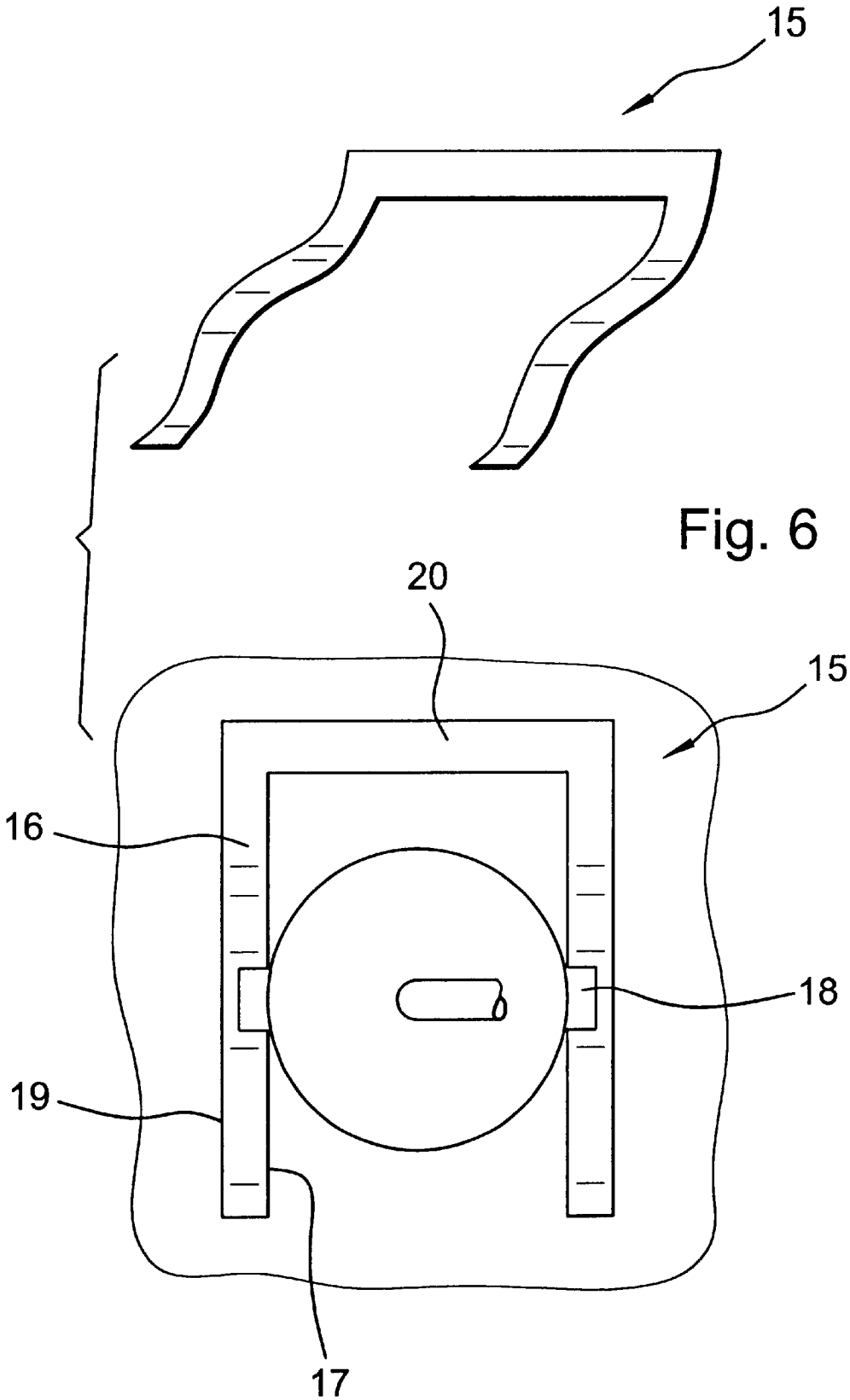
FIG. 6 shows a view from below of a U-shaped torsion spring that is frictionally connected to a cylindrical burner body.

In FIG. 6, U-shaped leaf spring 15 is used as a spring element and its two legs 16 are bent upward over their width and rest on a companion flange 18 that is molded onto burner body 3 and press with their outside edges 19 in each case against cooking surface bottom side 8, by which a frictional connection is produced.

In the embodiments according to FIGS. 2 *a–c*, 4 and 6, cooking surface 4 in the surface area that directly adjoins burner opening 6 is made flat, so that collar 5 that goes around the burner top portion is advantageously also made flat on its bottom side for seating on cooking surface top 7. For secure sealing of the space that is under cooking surface 4 from food that has boiled over while being cooked, a thermostable seal 10 is therefore inserted preferably between the collar bottom side and surface area 7 that directly adjoins burner opening 6 of cooking surface 4, on which collar 5 rests. This can be eliminated if an embodiment according to FIG. 7 is used.

Figure 7:
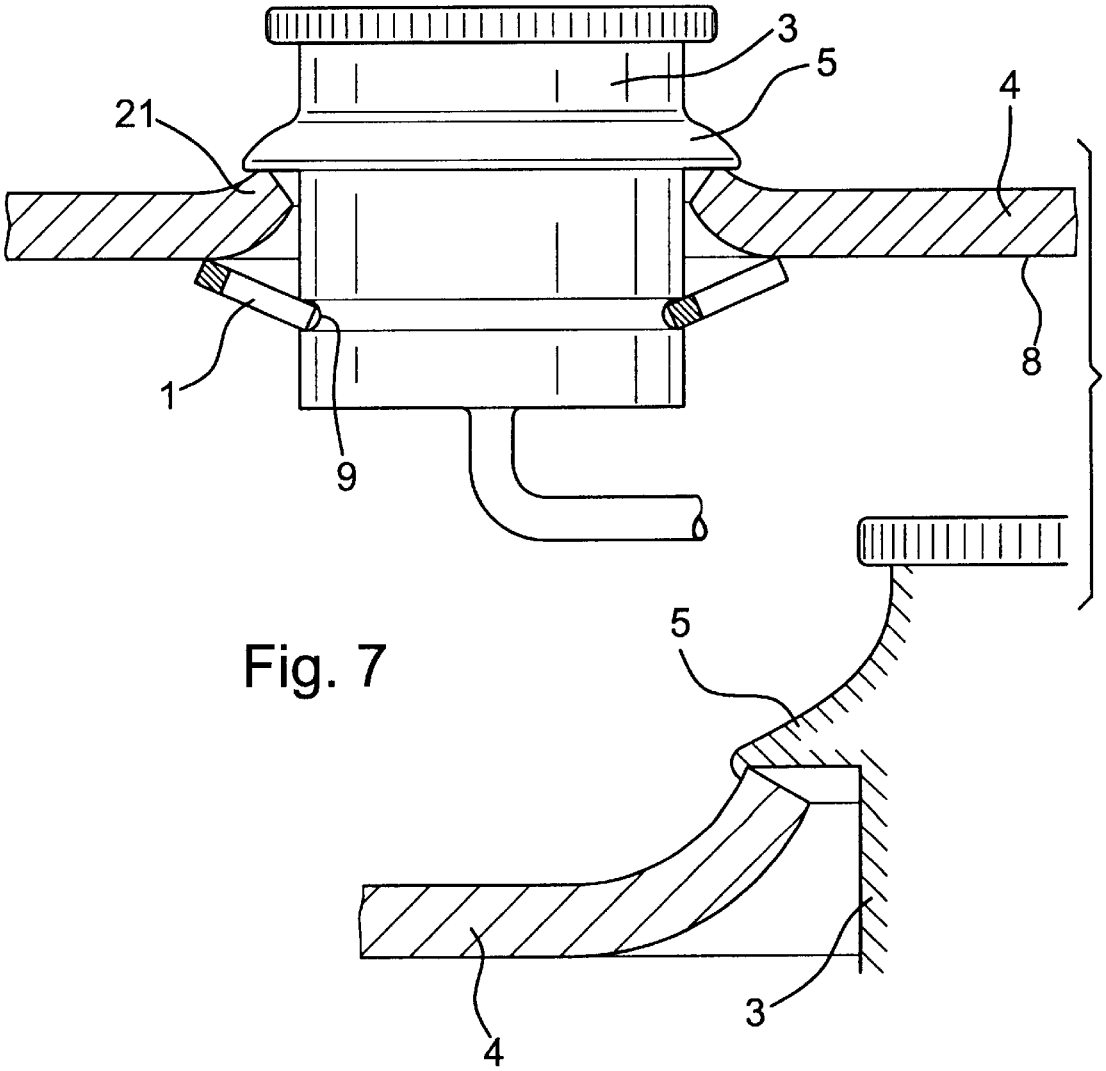
FIG. 7 shows a cross-section of a burner that is attached to a cooking surface opening and that has the embodiment where the circumferential collar that is molded onto the burner body is designed in the form of a flat frustum jacket that rests on its base periphery on the cooking surface top side, and the cooking surface is curved upward in the immediate peripheral area of the burner opening.

In FIG. 7, cooking surface 4 is curved upward in the peripheral area of burner opening 6. Circumferential collar 5 that is molded onto burner body 3 then lies directly on the upper edge of arching 21 that is in the peripheral area of burner opening 6. An additional seal 10 can be avoided in this case. The arching prevents food that has boiled over from getting inside. The spring elements that are reproduced in FIG. 7 on the part of the burner that is located under cooking surface 4 corresponds to the embodiment according to FIG. 2*a*, whereby embodiments according to FIGS. 2*b* and *c*, 4 or 6 are also possible.

What is claimed is:

1. An arrangement for mounting a burner in an opening through a glass or glass ceramic cooking surface having a top and bottom face, comprising:

a barrel on the burner, the barrel having a diameter substantially similar to the burner and being coaxial therewith, the barrel extending through the opening and having a support portion extending below the bottom face of the cooking surface, the support portion providing a means below the bottom face for supporting a spring member;

an exterior flange on the barrel portion for engaging the top face adjacent the opening, and a spring member extending between the support on the barrel and bottom face of the cooking surface for urging the flange against the top face to resiliently retain the burner in the opening.

2. The arrangement of claim 1, wherein the spring member has an inner portion and an outer portion and wherein the inner portion bears against the support portion of the barrel with friction providing the spring member supporting means and the outer portion bears against the bottom face of the cooking surface.

3. The arrangement of claim 2, wherein the inner portion includes an edge and wherein at least a portion of the edge frictionally engages the surface of the the support portion of the barrel while the outer portion bears against the bottom face of the cooking surface tensioning the spring.

4. The arrangement of claim 3, wherein the spring undulates in a radial direction and has an inner diameter less than the outer diameter of the barrel portion of the burner when the spring is relaxed and an inner diameter equal to the outer diameter when the spring is supported on the barrel and the top portion is bearing against the bottom face of the cooking surface.

5. The arrangement of claim 2, wherein the spring supporting means of the barrel is a groove in the surface thereof for receiving the inner portion of the spring.

6. The arrangement of claim 3, wherein the supporting means is a plurality of axially spaced notches in the support portion of the barrel for receiving the edge of the inner portion of the spring.

7. The arrangement of claim 6, wherein the spring undulates in a radial direction and has an inner diameter less than the outer diameter of the support portion of the barrel when the spring is relaxed and an inner diameter equal to the outer diameter when the spring is mounted on the support portion of the barrel and the top portion is bearing against the bottom face of the cooking surface.

8. The arrangement of claim 5, wherein the spring undulates in a radial direction and has an inner diameter less than the outer diameter of the support portion of the barrel when the spring is relaxed and an inner diameter equal to the outer diameter when the spring is mounted on the support portion of the barrel and the top portion is bearing against the bottom face of the cooking surface.

9. The arrangement of claim 5, wherein the spring is a leaf spring having legs received in the groove with portions of the legs being biased toward the bottom face of the cooking surface.

10. The arrangement of claim 5, wherein the spring is U-shaped with legs received in the groove and portions biased toward the bottom face of the cooling surface.

11. The arrangement of claim 2, further including a thermosetting seal between the flange on the barrel and the top face of the cooking surface.

12. The arrangement of claim 11, further including a raised circular lip around the opening through the cooking surface for engaging the flange on the burner.

13. A cooking top having the arrangement for mounting burners as in set forth in claim 2.

* * * * *